US005947474A

United States Patent [19]

Kanagawa et al.

[11] Patent Number: 5,947,474

[45] Date of Patent: Sep. 7, 1999

[54] GAME WITH MOVABLE FIGURE

[75] Inventors: Kazutsugu Kanagawa, Toda; Asayoshi Asami, Kawasaki, both of Japan; Daniel J. DeOreo, Manchester, Mass.; Chris Conger, Redondo Beach, Calif.

[73] Assignee: Hasbro, Inc., Pawtucket, R.I.

[21] Appl. No.: 08/919,173

[22] Filed: Aug. 28, 1997

[51] Int. Cl.[6] ..... A63F 3/00

[52] U.S. Cl. ..... 273/288; 446/297

[58] Field of Search ..... 463/1, 22; 446/268, 446/297, 397, 270, 404, 368; 273/236–238, 242–243, 138.1, 138.2, 139, 288, 287, 289, 146, 292, 293, 308, 460; 364/410.1

[56] References Cited

U.S. PATENT DOCUMENTS

| | | | |
|---|---|---|---|
| 4,309,035 | 1/1982 | Goldfarb | 273/237 |
| 4,799,678 | 1/1989 | Terzian et al. | 273/1 E |
| 4,948,146 | 8/1990 | Snyder et al. | 273/273 |
| 5,073,140 | 12/1991 | Lebensfeld et al. | 446/297 |
| 5,190,296 | 3/1993 | Sainsbury | 273/296 |
| 5,540,439 | 7/1996 | Kamentsky | 273/241 |

*Primary Examiner*—Jessica J. Harrison
*Assistant Examiner*—Mark A. Sager
*Attorney, Agent, or Firm*—Fish & Richardson P.C.

[57] ABSTRACT

A game with a movable figure includes a processor positioned in the movable figure configured to generate messages for moving the figure. An output device is connected to the processor and configured to provide the messages to a person playing the game. An input device, located on the movable figure, is connected to the processor and configured to activate the processor.

16 Claims, 5 Drawing Sheets

190

| Program Step f(x) | Moves/ Splash | 2 Player A | 2 Player B | 3 Player A | 3 Player B | 3 Player C | 4 Player A | 4 Player B | 4 Player C | 4 Player D |
|---|---|---|---|---|---|---|---|---|---|---|
| 1 | 3 | 3 | | 3 | | | 3 | | | |
| 2 | 2 | | 2 | | 2 | | | 2 | | |
| 3 | Splash | Splash | | | | Splash | | | Splash | |
| 4 | 1 | | 1 | 1 | | | | | | 1 |
| 5 | 4 | 4 | | | 4 | | 4 | | | |
| 6 | 3 | | 3 | | | 3 | | 3 | | |
| 7 | 2 | 2 | | 2 | | | | | 2 | |
| 8 | Splash | | Splash | | Splash | | | | | Splash |
| 9 | 1 | 1 | | | | 1 | 1 | | | |
| 10 | 4 | | 4 | 4 | | | | 4 | | |
| 11 | 3 | 3 | | | 3 | | | | 3 | |
| 12 | 4 | | 4 | | | 4 | | | | 4 |
| 13 | Splash | Splash | | Splash | | | Splash | | | |
| 14 | 1 | | 1 | | 1 | | | 1 | | |
| 15 | 4 | 4 | | | | 4 | | | 4 | |
| 16 | 2 | | 2 | 2 | | | | | | 2 |
| 17 | 1 | 1 | | | 1 | | 1 | | | |
| 18 | Splash | | Splash | | | Splash | | Splash | | |
| 19 | 2 | 2 | | 2 | | | | | 2 | |
| 20 | 3 | | 3 | | 3 | | | | | 3 |
| 21 | 2 | 2 | | | | 2 | 2 | | | |
| 22 | Splash | | Splash | Splash | | | | Splash | | |
| 23 | Splash | Splash | | | Splash | | | | Splash | |
| 24 | 4 | | 4 | | | 4 | | | | 4 |
| 25 | 2 | 2 | | 2 | | | 2 | | | |
| 26 | 3 | | 3 | | 3 | | | 3 | | |
| 27 | 4 | 4 | | | | 4 | | | 4 | |
| 28 | Splash | | Splash | Splash | | | | | | Splash |
| 29 | Splash | Splash | | | Splash | | Splash | | | |
| Total Moves | | 28 | 27 | 16 | 17 | 20 | 13 | 13 | 15 | 14 |
| Total Splashes | | 4 | 4 | 3 | 3 | 2 | 2 | 2 | 2 | 2 |

FIG. 6

GAME WITH MOVABLE FIGURE

BACKGROUND OF THE INVENTION

The invention relates to a game with a movable figure.

SUMMARY OF THE INVENTION

In one aspect, generally, the invention features a game having a movable figure. A processor positioned in the figure is connected to an input device and configured to respond to each actuation of the input device by generating a sequence of messages for prompting a person playing the game to move the movable figure. An output device is connected to the processor and configured to provide the messages to the person playing the game.

Embodiments of the invention may include one or more of the following features. The processor may be configured to insert a time delay between the messages. Generally, the time delay is sufficient to permit a person playing the game to move the figure between messages.

The game also may include a set of game pieces. Each game piece may include one of a set of different illustrations on its underside. The person playing the game may receive a game piece when the movable figure is located on a game piece having a particular illustration.

The movable figure may be shaped to resemble a frog. The output device may be a speaker, and the processor may be configured to provide the messages as audio messages using, for example, a voice synthesizer. The sequence of messages may include a hopping sound and a splashing sound. The processor may select a sequence of messages from a set of sequences.

The game also may include tokens. The person playing the game may receive a token when the movable figure is located on a game piece having a particular illustration.

Other features and advantages will become apparent from the following description, including the drawings, and from the claims.

BRIEF DESCRIPTION OF THE DRAWING

FIG. 6 is a table of message sequences implemented by the processor of the movable figure of FIG. 1.

DESCRIPTION OF THE PREFERRED EMBODIMENTS

Figure 1:
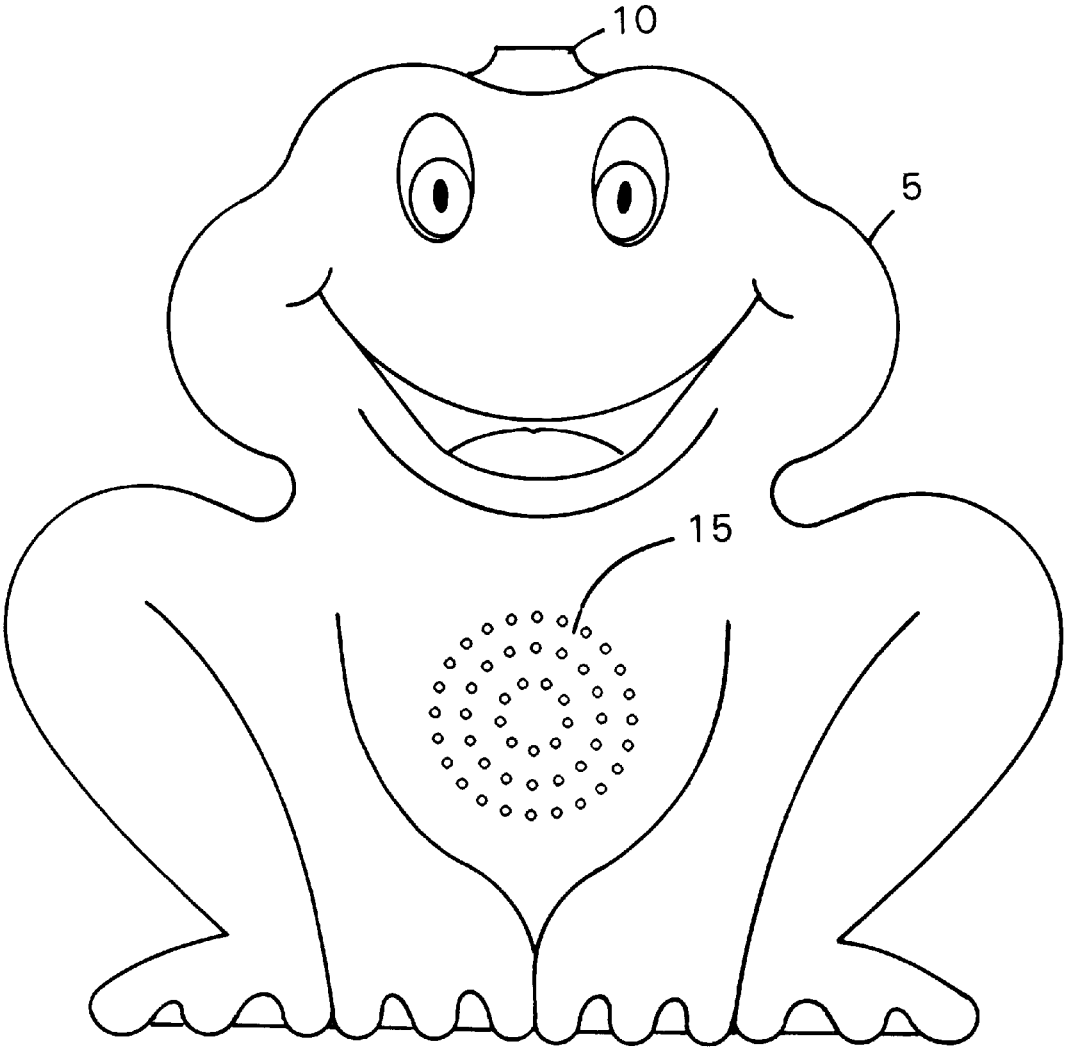
FIG. 1 is a front view of a movable figure.
Figure 2:
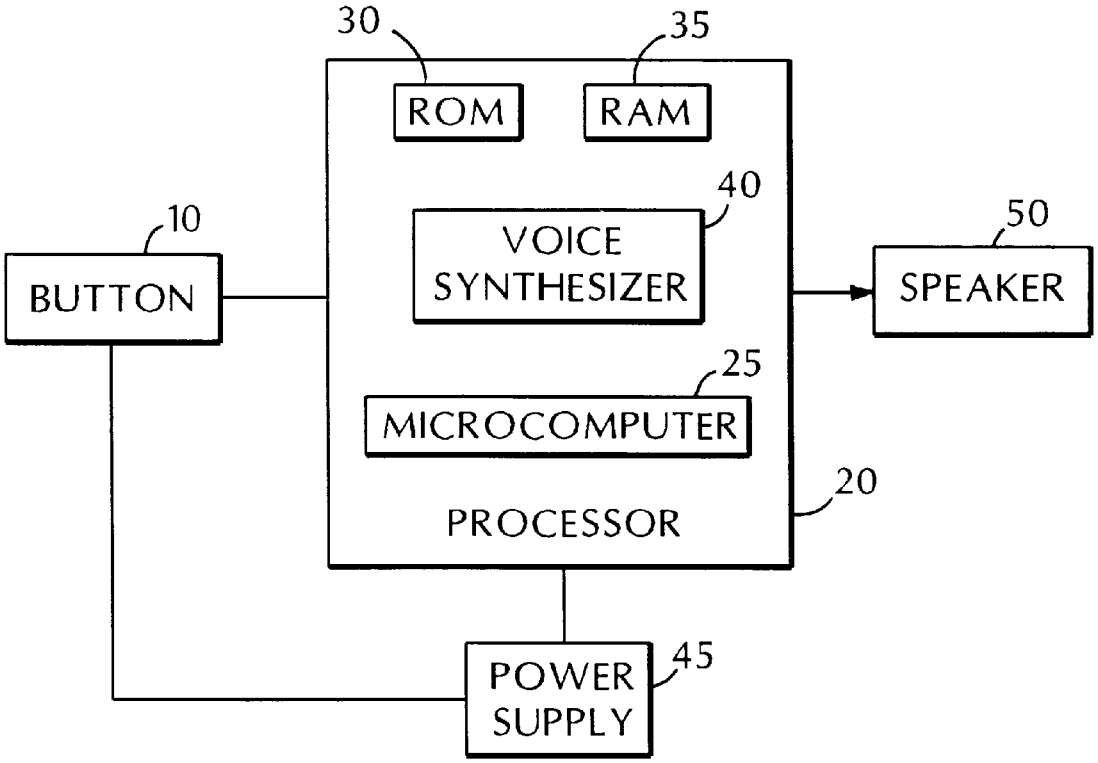
FIG. 2 is a block diagram of internal components of the movable figure of FIG. 1.

Referring to FIGS. 1 and 2, a movable figure in the shape of a frog 5 is controlled by a processor 20 that is located inside the frog 5. The processor 20 is implemented using a microcontroller that includes a microcomputer 25, read-only memory (ROM) 30, random access memory (RAM) 35, and a voice synthesizer 40. The ROM 30 stores game software while the RAM 35 stores current game information, such as the status of the game. The processor 20 is powered by a power supply 45, such as batteries (not shown) positioned within the frog 5.

The processor 20 responds to input signals from a button 10 located, for example, on top of the head of the frog 5. The processor 20 provides synthesized speech to a speaker 50 that is positioned in the frog's body 5. The processor 20 is controlled by software included in the ROM 30.

The software includes a sequence of five steps. One of the steps will be produced each time the button 10 is pressed by a player. Once the five steps are played, the software will repeat the sequence of steps according to the table provided in FIG. 6. FIG. 6 also illustrates the order in which the five steps will be produced for two to four players.

Figure 4:
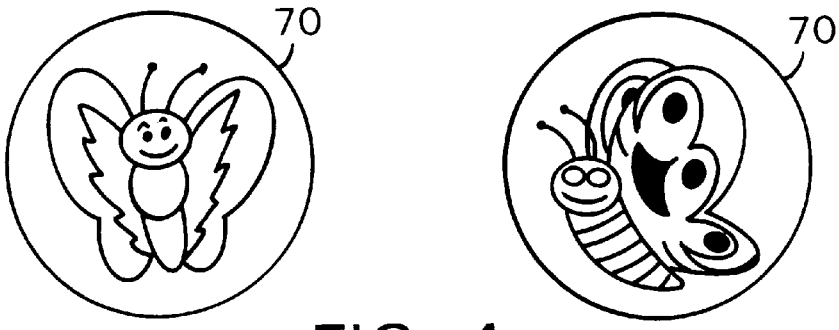
FIG. 4 is a perspective view of another component of the game of FIG. 3.
Figure 3:
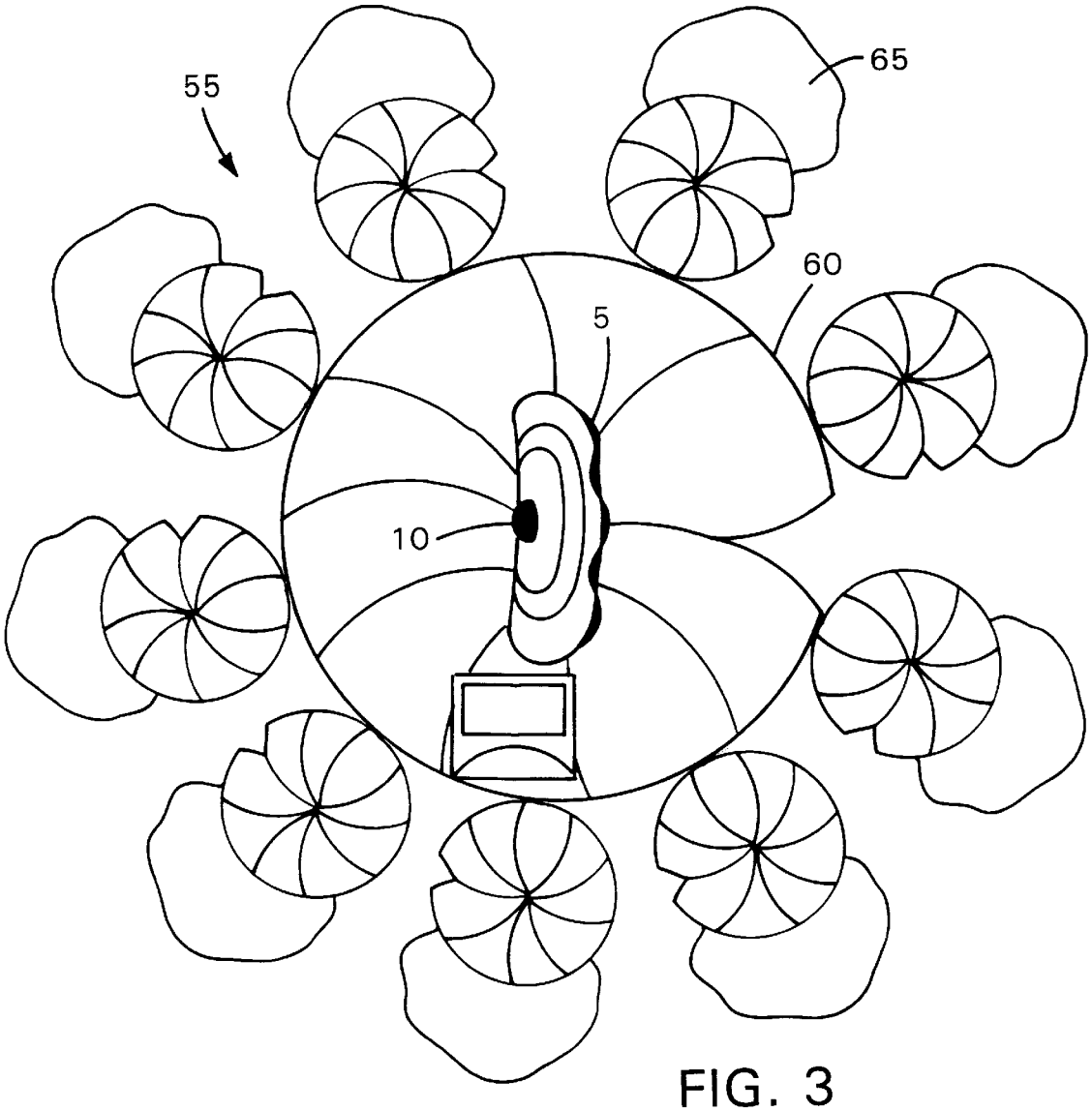
FIG. 3 is a top view of components of a game including the movable figure of FIG. 1.

Referring to FIGS. 3 and 4, a game 55 includes the frog 5, a large lily pad 60, a set of small lily pads 65 (e.g., nine in number), and a set of insect chips 70. Two or more players may play the game 55.

Before beginning the game 55, the frog 5, the large lily pad 60, and the small lily pads 65 are arranged with the frog 5 positioned on top of the large lily pad 60. The small lily pads 65 are placed around the large lily pad 60, as shown in FIG. 3.

To play the game 55, the first player presses the button 10 to activate the frog 5. Initially, the frog 5 prompts the player by asking, for example, "ready?" through the speaker 50 in a synthesized voice. The synthesized prompt notifies the players that the game 55 is about to start. The frog 5 then waits for a few seconds to allow the player to get ready to move the frog 5. After pausing, the frog 5 may produce, for example, either a "boing" sound or a "splash" sound.

If the frog 5 produces a "boing" sound, the player moves the frog 5 from the large lily pad 60 to any one of the small lily pads 65. The frog 5 may produce a sequence (e.g., one to four) of "boing" sounds with a pause between each pair of "boing" sounds. In response to each "boing" sound following the first one, the player moves the frog 5 from one small lily pad 65 to another. For example, after the player selects the first small lily pad 65 on which to land, the player may move the frog 5 in a counterclockwise or clockwise direction around the small lily pads 65 in response to each additional "boing" sound. The pause between each "boing" sound increases the player's anticipation as to whether the player will be allowed to further move the frog 5.

After the last "boing" sound, the frog 5 immediately generates an "end of turn" sound (e.g., a "ribbit" sound) and asks a question (e.g., "who's there?") in a synthesized voice. In response to the question, the player turns over the small lily pad 65 on which frog 5 is positioned to see whether the small lily pad 65 has an insect or an alligator on the underside. If the small lily pad 65 has an insect on the underside, the player collects one insect chip 70. The player does not collect the insect chip 70 if the small lily pad 65 has an alligator on the underside. The first player to collect a set number (e.g., three) of insect chips 70 wins the game.

Instead of generating a "boing" sound, the frog 5 may produce a "splash" sound and ask "who's there?". In response, the player may place the frog 5 on any one of the small lily pads 65 and check to see whether the underside of the selected small lily pad 65 has an insect or an alligator. If the selected small lily pad 65 has an insect on the underside, the player collects one insect chip 70. The player does not collect a insect chip 70 if the selected small lily pad 65 has an alligator on the underside.

To continue play, the next player presses the button 10. The frog 5 instructs the player by asking "ready?". The frog 5 then plays the next message in the sequence and the player proceeds as discussed above. Play continues until one player has collected a set number of insect chips 70.

In a second version of the game 55, the players move the frog 5 to the small lily pad 65 in response to either a "boing" or "splash" sound until the frog 5 asks "who's there?". The player must then guess whether there is a picture of an insect or an alligator on the underside of the small lily pad 65 on which the frog 5 is located. If the player guesses correctly, the player removes the small lily pad 65 from around the large lily pad 60. The player does not remove the small lily pad 65 if the guess is incorrect. The player who collects a fixed number (e.g., three) of small lily pads 65 first, wins the game 55.

Figure 5:
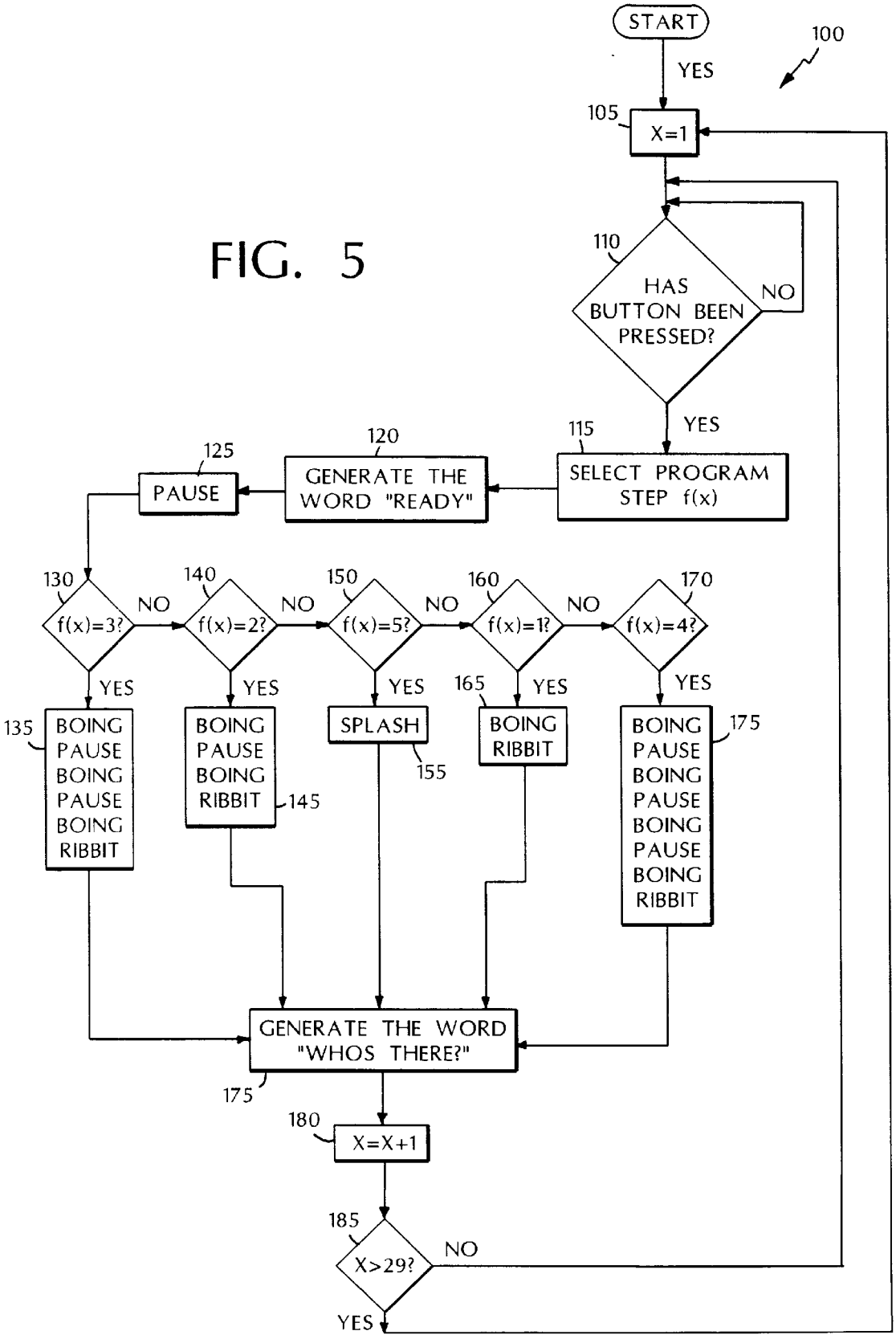
FIG. 5 is a flow chart of a procedure implemented by a processor of the movable figure of FIG. 1.

Referring to FIGS. 2 and 5, the processor 20 operates the frog 5 according to a procedure 100. The processor 20 calls the procedure 100 each time the button 10 is pressed.

Initially, the processor 20 sets the value of a variable x to one (step 105). In general, x may have any integer value from one to twenty nine, and relates to instructions that the frog 5 is going to announce to the players. When the button 10 is pressed (step 110), the processor 20 selects a program step f(x) (step 115) and causes the frog 5 to generate the spoken voice prompt "ready?" (step 120), which tells the player that the game 55 is about to start. The processor 20 makes this determination by examining a location in the RAM 30 which indicates that the button 10 has been pressed. After the "ready?" message is generated, the processor 20 pauses (step 125) before providing the next voice message.

If f(x) equals one (step 160), the processor 20 generates one "boing" sound, followed by the "ribbit" sound (step 165). The processor then generates the voice message "who's there?" (step 180). Once the frog 5 asks "who's there?", the player can turn over the small lily pad 65 that the frog 5 last landed on at the generation of the "boing" sound, and check whether the small lily pad 65 has an insect or an alligator located underneath. If the small lily pad 65 has an insect located underneath, the player collects one insect chip 70. If an alligator is located under the lily pad, the player does not collect the insect chip 70.

If f(x) equals two (step 140), the processor generates a series of two "boing" sounds, with a pause between the pair of "boing" sounds, followed by the "ribbit" sound (step 145). The processor 20 then proceeds as described above when f(x) equals one.

If f(x) equals three (step 130), the processor 20 generates a series of three "boing" sounds, with a pause between each pair of "boing" sounds, followed by a "ribbit" sound (step 135) and proceeds as described above when f(x) equals one.

If f(x) equals four (step 170), the processor generates a series of four "boing" sounds, with a pause between each pair of "boing" sounds, followed by the "ribbit" sound (step 175). The processor then proceeds as described above when f(x) equals one.

If x equals "S" (step 150), the processor 20 generates the "splash" sound (step 155). The processor 20 then generates the voice message "who's there?" (step 180). As noted above, the player who receives the "splash" sound is permitted to move the frog 5 to any one of the small lily pads 65 that surround the large lily pad 60 and check to see whether the small lily pad 65 has an insect or an alligator located on its underside. If the small lily pad 65 has an insect on the underside, the player collects one insect chip 70. Otherwise, the player does not collect the insect chip 70.

After the processor 20 generates the voice message "who's there?", the processor increments x by one (step 185), and determines if x is greater than twenty nine (step 190). If x is not greater than twenty nine, the processor 20 repeats the procedure by waiting for the button to be pressed again (step 110). If x is greater than twenty nine, the processor 20 resets x to one (step 105) and repeats the procedure.

The values for f(x) may be determined according to the table 190 provided in FIG. 6. For example, f(1) equals "3" while f(3) equals "S". The values for f(x) provide an interesting and balanced sequence of steps for each player in two, three or four player games.

Other embodiments are within the scope of the following claims.

What is claimed is:

1. A game, comprising:

a movable figure;

an input device;

a processor positioned in the movable figure, connected to the input device, and configured to respond to each actuation of the input device by generating a sequence of messages for prompting a person playing the game to move the movable figure, wherein a number of times that the person moves the movable figure varies with a number of messages in the sequence of messages; and an output device connected to the processor and configured to provide the messages to the person playing the game.

2. The game of claim 1, wherein the processor is further configured to generate a time delay between messages in the sequence of messages, the time delay being of sufficient duration to permit a person playing the game to move the movable figure between messages.

3. The game of claim 1, wherein the output device comprises a speaker.

4. The game of claim 3, wherein the processor is configured to generate the messages using a voice synthesizer.

5. The game of claim 1, wherein the processor is configured to generate the messages using a voice synthesizer.

6. The game of claim 1, wherein the input device comprises a button located on the movable figure.

7. The game of claim 1, wherein the movable figure is in the shape of a frog.

8. The game of claim 7, wherein a message of the sequence of messages comprises a hopping sound.

9. The game of claim 7, wherein the processor is configured to produce a splashing sound.

10. The game of claim 1, further comprising a set of game pieces, each game piece including one of a set of different illustrations on an underside of the game piece.

11. The game of claim 1, wherein the processor selects a sequence of messages from a set of sequences.

12. The game of claim 11, wherein the set of sequences includes five sequences.

13. A game, comprising:

a movable figure;

an input device;

a processor connected to the input device and configured to respond to each actuation of the input device by using a voice synthesizer to generate a sequence of messages for prompting a person playing the game to move the movable figure, wherein a number of times that the person moves the movable figure varies with a number of messages in the sequence of messages; and an output device connected to the processor and configured to provide the messages to a person playing the game.

14. The game of claim 13, wherein the processor is part of the movable figure.

15. The game of claim 13, wherein the output device comprises a speaker.

16. The game of claim 13, further comprising a set of game pieces, each game piece including one of a set of different illustrations on an underside of the game piece.

* * * * *